United States Patent [19]

Mochida et al.

[11] Patent Number: 5,069,493

[45] Date of Patent: Dec. 3, 1991

[54] DOOR LOCK DEVICE

[75] Inventors: Haruo Mochida; Yoshio Watanuki, both of Kanagawa, Japan

[73] Assignee: Nissan Motor Company, Ltd., Yokohama, Japan

[21] Appl. No.: 637,238

[22] Filed: Jan. 3, 1991

[30] Foreign Application Priority Data

Jan. 25, 1990 [JP] Japan ..... 2-15444

[51] Int. Cl.[5] ..... E05C 3/26

[52] U.S. Cl. ..... 292/336.3; 292/DIG. 65; 292/1

[58] Field of Search ..... 292/DIG. 65, 216, DIG. 22, 292/336.3, 347, 1; 296/146

[56] References Cited

U.S. PATENT DOCUMENTS 4,382,622 5/1983 Ishikawa ..... 292/DIG. 65 X 4,995,654 4/1991 Nishigami et al. ..... 292/DIG. 65 X

FOREIGN PATENT DOCUMENTS 58-44359 3/1983 Japan .

*Primary Examiner*—Richard E. Moore

*Attorney, Agent, or Firm*—Pennie & Edmonds

[57] ABSTRACT

In order to keep the latched condition of a door lock proper even when the associated door is considerably deformed due to a vehicle collision or the like, the outside lever extending from the door lock proper is provided with a pointed portion which is directed toward an outer panel of the door. Upon deformation of the outer panel, the pointed portion is forced to stick into the deformed outer panel establishing a locked engagement therebetween and thus preventing the door lock proper from taking the unlatched condition.

9 Claims, 4 Drawing Sheets

DOOR LOCK DEVICE

BACKGROUND OF THE INVENTION

1. Field of the Invention

The present invention relates to door lock devices, and more particularly, to door lock devices for a motor vehicle.

2. Description of the Prior Art.

In order to clarify the task of the present invention, one conventional door lock device disclosed in Japanese Utility Model First Provisional Publication No. 58-44359 will be outlined with reference to FIG. 12 of the accompanying drawings.

In the drawing, denoted by numeral 1 is a door of a motor vehicle, and 2 is an outer panel of the door 1. The outer panel 2 is formed at a waste line part with a recess 3 for receiving therein an outside handle 4. The outside handle 4 has an arm portion 5 which is projected into the door 1 through an opening 3*a* formed in the bottom of the recess 3. The arm portion 5 is pivotally connected through a pivot pin 6 to the door 1, so that the outside handle 4 pivots about the pivot pin 6 relative to the door 1. A rod 7 extends downward from a leading end of the arm portion 5.

Designated by numeral 8 is a door lock proper which is disposed in the door 1 near the outside handle 4. An outside lever 9 extends from the door lock proper 8 toward the outer panel 2 and has a leading end connected to a lower end of the rod 7.

When the outside handle 4 is pivoted upward, the rod 7 is moved downward and thus the outside lever 9 is pivoted downward to a position causing the door lock proper 8 to assume an unlatch condition. Upon this, the door 1 becomes unlatched from the vehicle body.

However, due to the arrangement wherein the outside handle 4 and the door lock proper 8 are positioned near each other, the above-mentioned conventional door lock device has the following drawback.

When, due to a vehicle collision or the like, the outer panel 2 of the door 1 is deformed inwardly to a certain degree, it tends to occur that the inwardly curved lower portion 3*b* of the recess 3 contacts and slides on the leading end of the outside lever 9 moving the outside lever 9 downward. This phenomenon brings about an undesirable unlatch condition of the door lock proper under the vehicle collision.

SUMMARY OF THE INVENTION

It is therefore an object of the present invention to provide a door lock device which is free of the above-mentioned drawback.

According to the present invention, there is provided a door lock device which can keep a latched condition of a door lock proper even when the door is deformed due to a vehicle collision or the like.

According to the present invention, there is provided a door lock device for use with a door having an outer panel. The door lock device comprises an outside handle operatively mounted on the outer panel; a door lock proper installed in the door and having an outside lever, the outside lever bringing about an unlatched condition of the door lock proper when moved in a given direction; a connecting rod connecting the outside handle with the outside lever, so that movement of the outside handle in one direction causes movement of the outside lever in the given direction; and means for establishing a locked engagement between the outside lever and the outer panel when they are brought into abutment with each other.

BRIEF DESCRIPTION OF THE DRAWINGS

Other objects and advantages of the present invention will become apparent from the following description when taken in conjunction with the accompanying drawings, in which.

DETAILED DESCRIPTION OF THE INVENTION

Figure 1:
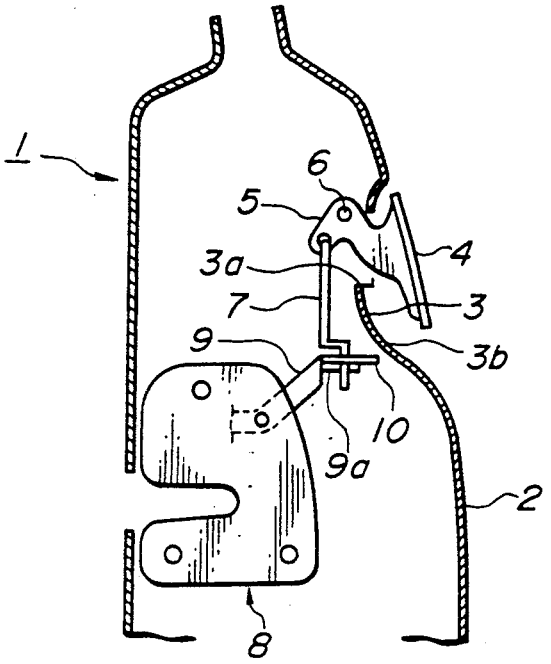
FIG. 1 is a sectional view of a vehicle door to which a first embodiment of the door lock device of the present invention is applied.
Figure 2:
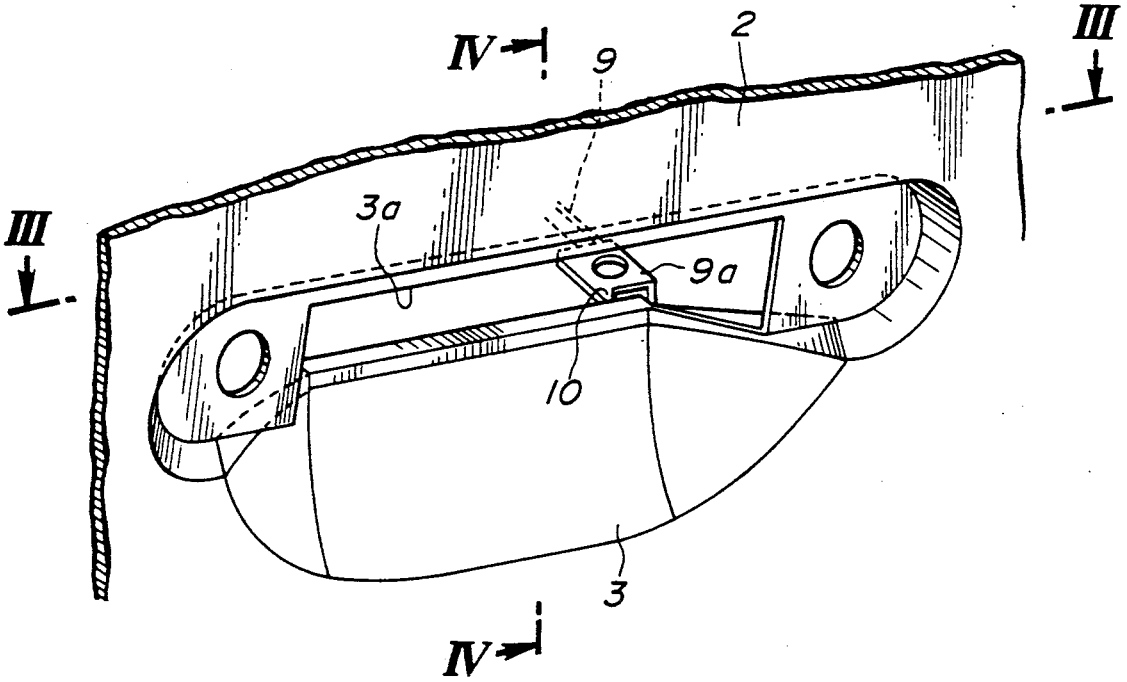
FIG. 2 is a perspective view of a part of the door, showing a positional relationship between an outer panel of the door and an outside lever of a door lock proper.

Referring to FIGS. 1 to 5, particularly FIG. 1, of the accompanying drawings, there is shown a first embodiment of the present invention. In the drawings, the parts substantially the same as those in the abovementioned conventional door lock device are designated by the same numerals.

As is seen from FIG. 1, an outside handle 4 is received in a recess 3 formed in an outer panel 2 of a door 1. The outside handle 4 has an arm portion 5 which is projected into the door 1 through an opening 3*a* formed in the bottom of the recess 3. Although not shown in the drawing, a handle bracket is secured to the arm portion 5. The arm portion 5 is pivotally connected through a pivot pin 6 to the door 1, so that the outside handle 4 pivots about the pivot pin 6 relative to the door 1. A rod 7 extends downward from a leading end of the arm portion 5.

Designated by numeral 8 is a door lock proper which is tightly disposed in the door 1. An outside lever 9 extends from the door lock proper 8 toward the outer panel 2 and has a leading end connected to a lower end of the rod 7. As shown in FIG. 1, the leading end of the outside lever 9 is positioned near a smoothly curved lower part 3*b* of the recess 3 of the outer panel 2.

Thus, when the outside handle 4 is pivoted upward, the rod 7 is moved downward and thus the outside lever 9 is pivoted downward to a position causing the door lock proper 8 to assume an unlatch condition. Upon this, the door 1 is unlatched from the vehicle body.

According to the present invention, the following measure is employed in the leading end of the outside lever 9.

Figure 3:
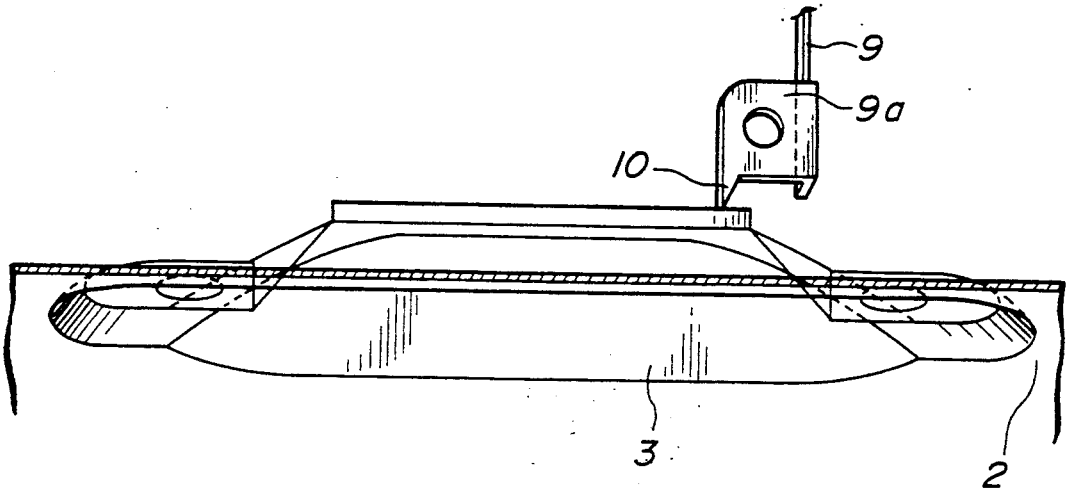
FIG. 3 is a sectional view taken along the line III—III of FIG. 2.
Figure 4:
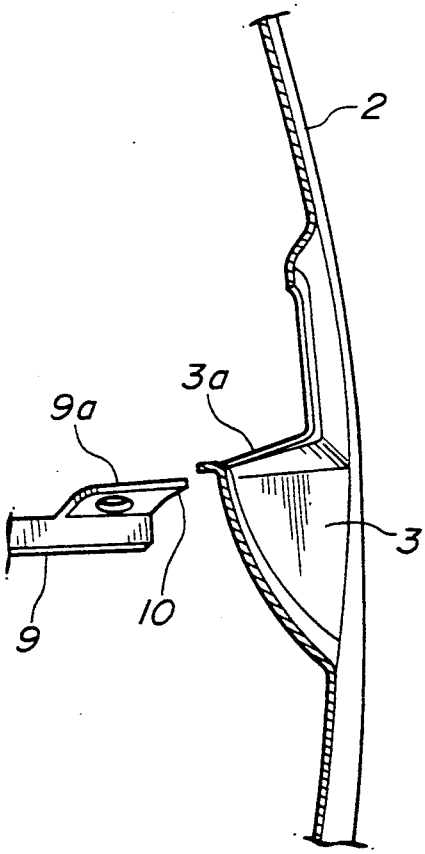
FIG. 4 is a sectional view taken along the line IV—IV of FIG. 2.
Figure 12:
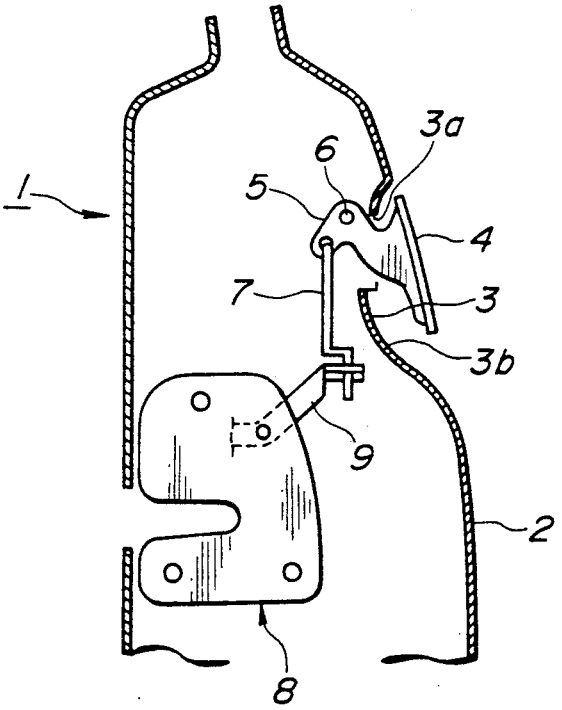
FIG. 12 (PRIOR ART)
FIG. 12 is a view similar to FIG. 1, but showing a conventional door lock device.

That is, as is best understood from FIGS. 3 and 4, the leading end of the outside lever 9 is formed with an apertured metal piece 9*a*. The aperture of the piece 9*a* has the lower end of the rod 7 received therein for achieving the connection therebetween.

Figure 5:
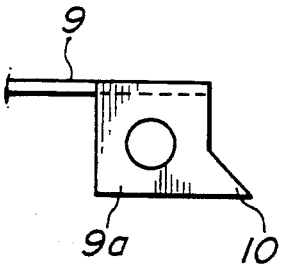
FIG. 5 is a plan view of a leading end of the outside lever.

As is best seen from FIGS. 3 and 5, the metal piece 9*a* is formed at one corner thereof with a pointed portion 10 which is directed toward the smoothly curved lower part 3*b* of the recess 3 of the outer panel 2.

When, due to a vehicle collision or the like, the outer panel 2 of the door 1 is deformed inwardly to such a degree that the smoothly curved lower portion 3*b* of the recess 3 abuts against the leading end of the outside lever 9, the pointed portion 10 of the metal piece 9*a* is forced to stick into the curved lower portion of the recess 3 suppressing the sliding movement of the portion 3*b* relative to the outside lever 9. Thus, under this condition, the door lock proper 8 is prevented from taking the unlatch condition and thus the door 1 is kept latched relative to the vehicle body.

FIGS. 6 to 10 respectively show modifications of the pointed portion 10.

Figure 6:
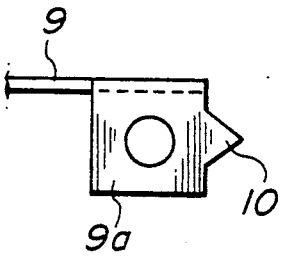
FIGS. 6, 7, 8, 9 and 10 are views similar to FIG. 5, but showing various modifications of the leading end of the outside lever.
Figure 7:
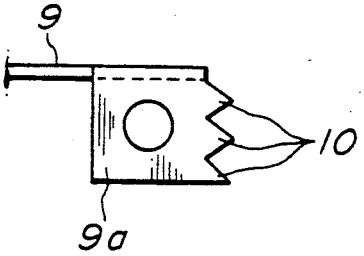
Figure 8:
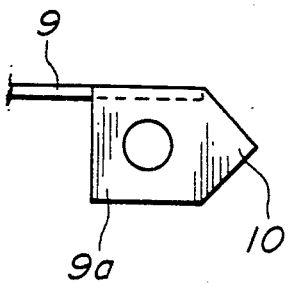
Figure 9:
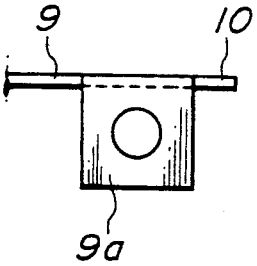
Figure 11:
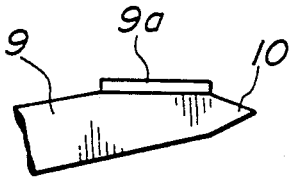
FIG. 11 is a side view of the leading end shown in FIG. 9.
Figure 10:
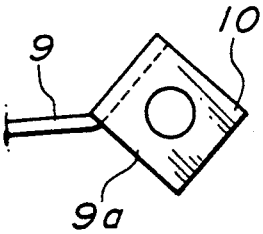

The pointed portion 10 shown in FIG. 6 is formed at the center of a terminal end of the metal piece 9*a*. The modification shown in FIG. 7 has a saw-teeth configuration, and the modification shown in FIG. 8 is a tapered end of the metal piece 9*a*. The modification shown in FIGS. 9 and 11 is a pointed terminal end of the outside lever 9. In the modification shown in FIG. 10, the leading end portion of the outside lever 9 is bent to permit one corner of the metal piece 9*a* to serve as the pointed portion 10.

As is understood from the foregoing description, due to the locked or stuck engagement between the outside lever 9 and the outer panel 2, the door lock device of the present invention can keep the latched condition even when the associated door is considerably deformed due to a vehicle collision or the like.

What is claimed is:

1. A door lock device for use with a door having an outer panel, said door lock device comprising:

an outside handle operatively mounted on said outer panel;

a door lock proper installed in said door and having an outside lever which is directed toward said outer panel, said outside lever bringing about an unlatched condition of said door lock proper when moved in a given direction;

a connecting rod connecting said outside handle with said outside lever, so that movement of said outside handle in one direction causes movement of said outside lever in said given direction; and means for establishing a locked engagement between said outside lever and said outer panel when they are brought into abutment with each other, said means including a pointed portion provided on the leading end of said outside lever.

2. A door lock device as claimed in claim 1, in which the point of said means comprises a pointed portion is directed toward said outer panel.

3. A door lock device as claimed in claim 2, in which said pointed portion is integrally formed on a metal piece which is secured to said outside lever.

4. A door lock device as claimed in claim 3, in which said metal piece has said connecting rod connected thereto.

5. A door lock device as claimed in claim 4, in which said pointed portion constitutes a plurality of teeth.

6. A door lock device as claimed in claim 2, in which said pointed portion is integrally formed on the leading end of said outside lever.

7. A door lock device as claimed in claim 6, in which said outside lever is provided with a metal piece to which said connecting rod is connected.

8. A door lock device as claimed in claim 4, in which said outside lever is bent to direct one pointed corner of said metal piece toward said outer panel.

9. In an automotive door having an outer panel, means for defining a recess on an outer surface of said outer panel;

an outside handle movably disposed in said recess, said outside handle having an arm portion which is projected into said door through an opening formed in a bottom of said recess;

pivot means for allowing said outside handle to pivot relative to said outer panel;

a door lock proper installed in said door and having an outside lever which is directed toward said outer panel, said outside lever bringing about an unlatched condition of said door lock proper when moved in a given direction; and a connecting rod connecting said arm portion with said outside lever, so that pivotal movement of said outside handle in one direction causes movement of said outside lever in said given direction;

wherein said outside lever is provided at its leading end with a pointed portion which is directed toward said outer panel.

* * * * *